US005133281A

United States Patent [19]

Eriksson

[11] Patent Number: 5,133,281

[45] Date of Patent: Jul. 28, 1992

[54] APPARATUS FOR COATING A TRAVELLING WEB

[75] Inventor: Tore Eriksson, Ö. Rud, Sweden

[73] Assignee: BTG Källe Inventing AB, Säffle, Sweden

[21] Appl. No.: 656,683

[22] Filed: Feb. 19, 1991

Related U.S. Application Data

[63] Continuation of Ser. No. 411,118, Sep. 22, 1989, Pat. No. 5,031,569.

[30] Foreign Application Priority Data

Sep. 27, 1988 [SE] Sweden ..... 8803423

[51] Int. Cl.[5] ..... B05C 1/04

[52] U.S. Cl. ..... 118/407; 118/410; 118/411; 118/412

[58] Field of Search ..... 118/230, 259, 246, 249, 118/258, 319, 261, 262, 413, 255, 257, 407, 416, 231, 410, 411, 412

[56] References Cited

U.S. PATENT DOCUMENTS

| | | | |
|---|---|---|---|
| 2,855,894 | 10/1958 | White et al. | 118/258 |
| 3,461,837 | 8/1969 | Dreher | 118/262 |
| 4,106,433 | 8/1978 | Fernando et al. | 118/246 X |
| 4,357,370 | 11/1982 | Alheid | 118/261 X |
| 4,465,015 | 8/1984 | Osta et al. | 118/249 X |
| 4,465,544 | 8/1984 | Fischer et al. | 118/259 X |
| 4,524,715 | 6/1985 | Abrams | 118/249 X |
| 4,738,877 | 4/1988 | Krautzberger | 118/261 X |
| 4,789,432 | 12/1988 | Goodnow et al. | 118/261 X |
| 4,814,204 | 3/1989 | Carey et al. | 118/261 X |
| 4,869,933 | 9/1989 | Sollinger et al. | 118/410 X |

FOREIGN PATENT DOCUMENTS

| | | | |
|---|---|---|---|
| 995002 | 8/1976 | Canada | 118/255 |

*Primary Examiner*—Richard L. Chiesa

*Attorney, Agent, or Firm*—Burns, Doane, Swecker & Mathis

[57] ABSTRACT

An apparatus for coating a travelling web (5), having supply systems (10,15,16;31,33;41;47,49;73) for the supply of coating agent (11) to the web (5), the systems including a metering device (15;31;41;47,49;75;77) extending across the whole width of the web and which by an intermittent contact surface (27,29;37,39;43,45;47;49) provides intermittent engagement with the web (5) or a backing member (3) against which the web subsequently comes to engagement, for the deposition of strands of coating agent (11) on the web (5) or the backing member (3).

7 Claims, 2 Drawing Sheets

APPARATUS FOR COATING A TRAVELLING WEB

This application is a continuation of application Ser. No. 07/411,118, filed Sep. 22, 1989, now U.S. Pat. No. 5,031,569.

BACKGROUND OF THE INVENTION

The present invention relates to an apparatus for the coating of a travelling web, said apparatus comprising means for the supply of coating agent to the web.

The basic principle in the coating of travelling webs, in particular paper webs, is that coating agent or coating composition is supplied to the web in excess. This excess of coating agent is then drained and recirculated. A typical example are so called blade coaters where the excess is scraped off by means of a flexible blade in engagement with the web. The pressure of the blade against the web is counterbalanced by an equally large reaction pressure which arises in two different ways, namely:

a) from the web, i.e. the blade engages the highest points of the web which are partly compressed by the blade pressure, and b) from the hydrodynamic pressure formed in the pool of coating composition which is present before the entrance to the blade nip.

The pressure depends on web speed, the viscosity of the coating agent, the angle of the blade to the web and the applied quantity of coating agent. In practical operation usually a combination of the reaction pressures given under a) and b) is at hand. In those cases wherein factor a) is predominant, i.e. the blade is supported against the web so that coating agent will fill up only the valleys and cavities of the web, there usually will be obtained an even coating profile along and across the web.

In those cases where factor b) is predominant (for example with paper qualities having high surface eveness and the coating weight is high) the blade will mainly "flow" on a film of coating agent. In this case the pressure of the blade will be mainly balanced by the hydrodynamic pressure which, as previously indicated, is dependent on the factors:

c) web speed d) viscosity e) blade angle f) the quantity of coating composition transported up to the blade, i.e. the quantity of coating composition applied to the web.

The factors according to items c) to e) can with sufficient accuracy be maintained constant using techniques available today. However, factor f) is dependent on the ability of the applicator to deposit on the web layer in the correct quantity along and across the web.

In blade coating it is conventional techniques to deposit coating agent on the web using so called coating rolls or fountain applicators. Thus, an even layer of coating agent is transferred onto the web by the applicator. The thickness of the layer can be calculated according to the following formula:

$$t = \frac{Q \cdot n}{\rho \cdot p \cdot 10}$$

where t=thickness of layer from applicator (mm)

Q=dry coating weight ($g/m^2$)

n=excess from applicator (times)

$\rho$=density of coating liquid ($g/cm^3$)

p=coating liquid solid's contents (%)

As examples can be given $$t = \frac{20 \cdot 15}{60 \cdot 1{,}5 \cdot 10} = 0.33 \text{ mm}$$

In a conventional applicator the layer is deposited by passing the liquid through a slit which is formed between the web supported by a backing roll and the exit rib of the fountain or the roll surface in roll applicators. In so called jet-fountain coaters the fountain has a larger distance to the web and the liquid is supplied to the web through a narrow slit. In the so called twin-blade techniques the web is brought to engagement against the exit slit by deflecting the web across the slit.

The difficulty in coating a web with an even layer having a thickness of the order as given in the example above in machines of widths used in paper manufacture has, in practice, been found to be quite pronounced. These difficulties include varying slit dimensions between paper web and exit slit in applicators or rolls depending on manufacture tolerances, heat tensions, deflexions, etc. In jet-fountain coaters the difficulties can reside in for example clogging of the slit, tolerance of the slit opening and the pressure distribution in the extruder. In fountain applicators according to the so-called twin-blade techniques the difficulties reside in obtaining even pressure distribution in the exit slit and maintaining even tension along and across the web.

Another type of coaters is the so called Short-dwell-bladecoater where the liquid is pumped into a chamber the front wall of which is formed by the coating blade. The excess of coating agent usually is drained out in the slit between the rear wall and the web supported by the backing roll. It is true that with this coater an even layer must not be deposited before the blade whereby some of the difficulties previously described are reduced, but the difficult problem of even pressure distribution in the chamber remains. Another problem which is associated with these techniques is that enclosed air bubbles do not disappear before the blade but pass the blade and result in so called skip-coating.

SUMMARY OF THE INVENTION

The techniques according to the present invention aim at eliminating the problems described above in connection with the difficult types of conventional coaters.

These and other objects are obtained by the apparatus according to the invention wherein the coating agent is deposited on the travelling web by means of a metering device engaging the web. This metering device can be designed in different ways but it involves in principle deposition of a coating agent in strings or strands of controlled thickness and width. These strings or strands of coating agent shall have such distribution that they merge and form a dam in front of the evening member, for example a coating blade. Moreover, it is essential to position the metering device so close to the evening member that the coating agent is not allowed to penetrate into the travelling web, thereby resulting in strands containing a higher coated quantity.

Accordingly, the invention offers an apparatus for the coating of a travelling web, especially a paper web, said apparatus comprising means for the supply of coating agent to said web. The apparatus is characterized thereby that said means comprise a metering device extending across the whole width of the web and which by an intermittent contact surface provides intermittent engagement with the web or a backing member against which the web subsequently comes to engagement. Thus, the apparatus provides for deposition of strings or strands of coating agent on the web or the backing member. It is particularly preferred to provide for an arrangement where the metering device is supported or carried over the whole length thereof.

In a preferred embodiment of the invention said metering device is constituted by a toothed blade or lamella and said blade or lamella is in contact with the web or the backing member during the application procedure.

According to an alternative embodiment of the invention said metering device is constituted by a metering rod which is provided with circumferential grooves or rings which provide for intermittent engagement with the web or the backing member during the deposition of strings or strands of coating agent. The metering rod can be rotatively mounted in a rod fixture but may, alternatively, be fixedly mounted but adjustable by rotation, the groove depth varying around the metering rod so as to enable controlled metered quantity of coating agent.

According to an alternative and preferred embodiment of the apparatus according to the invention the metering device can comprise a continuous blade defining a fixed gap determining the thickness of coating agent deposited onto the web or the backing member. The metering device further comprises a toothed blade placed downstream, said blade having teeth which are longer then the thickness of the fixed slit. This toothed blade is suitable springbiassed for successive adaptation to the web or the backing member synchronously with the wear of the teeth. The combination of these two blades thus results in the deposition of strings or strands of constant thickness and width, which in turn provides for even metering of coating agent.

It is preferred that the blades in this alternative embodiment are in engagement with each other. They can suitably be carried by a blade fixture carrying both the blade defining the slit and involving a blade holder carrying the toothed blade and further including a spring member for biassing the toothed blade against the web or the backing member, whereby the wear of the teeth is compensated by the successive feeding of the blade.

According to still another preferred embodiment of the apparatus according to the invention it is possible by using same to provide for two-sided coating of a travelling web, and the apparatus comprises for this purpose two juxtaposed metering members, the recesses of the discontinuous contact surfaces thereof being displaced side-wise relative to each other and between which the web travels. This embodiment suitably comprises two juxtaposed toothed lamellae, wherein the tooth width is less than the gap width, whereby the web in its passage between the lamellae assumes wave shape by the fact that the teeth of one lamella are juxtaposed the other lamella's gaps between the teeth. In this manner flexibility in the engagement of the two juxtaposed lamellae against each other will be obtained.

BRIEF DESCRIPTION OF THE DRAWINGS

The present invention will now be further illustrated by non-limiting embodiments in connection with the appended drawings, wherein:

FIG. 4 shows a diagrammatical view in section of another embodiment of the apparatus according to the invention, whereas

DETAILED DESCRIPTION OF THE PREFERRED EMBODIMENTS

Figure 1:
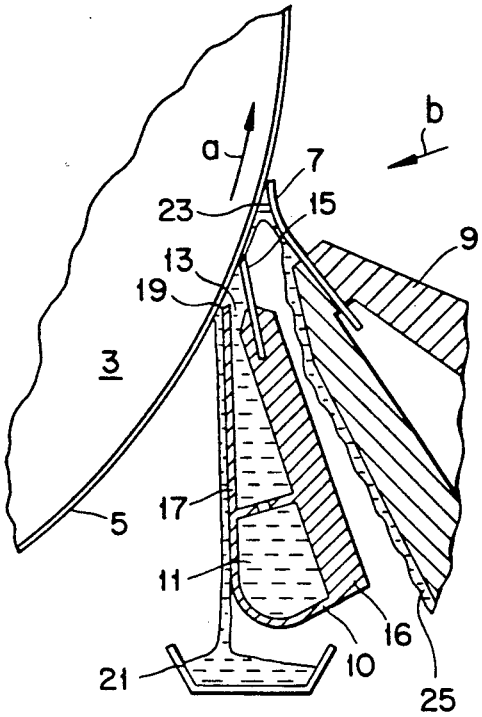
FIG. 1 is a diagrammatical view in section showing an embodiment of the apparatus according to the invention and FIG. 1A shows an enlarged detail of this apparatus.

The apparatus shown in FIG. 1 comprises a backing roll 3 which is shown only partly and diagrammatically and the paper web 5 travelling above said roll. The backing roll 3 rotates in the direction of arrow a). The coating apparatus further comprises a coating blade 7 attached in a conventional manner to a blade holder 9. Furthermore, FIG. 1 shows in cross section a distributing tube 10 for coating composition 11, said tube extending across the whole width of the paper web 5. Through an exit slit 13 the coating composition 11 is fed out against a metering lamella 15 which is attached to a lamella holder 16. Also this metering lamella 15 extends across the whole width of the paper web 5. A return flow 17 of coating composition is collected in a container 21 for recirculation.

Figure 1A:
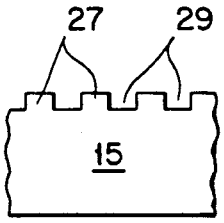

In FIG. 1A there is shown in enlargement a section of the metering lamella 15 seen in the direction of arrow b). As is clear from FIG. 1A this metering lamella 15 is provided with teeth 27 which, as is apparent from FIGS. 1 and 1*a* , contact the web intermittently at spaced locations, and gaps 29 between said teeth on the edge facing the paper web 5, said teeth and gaps resulting in deposition of parallel strings or strands of coating composition of defined cross section at the spaced locations by the metering lamella 15 thus providing for accurate dosage of coating composition. The distance between the metering lamella 15 and the coating blade 7 is adapted so that these strands of coating composition 11 before entering the site of contact between coating blade 7 and paper web 5 merge to form a dam 23 resulting in even deposition of coating composition across the whole width of the paper web 5.

Thanks to the construction and function of the apparatus described the previously indicated problems of maintaining constancy will be eliminated and there is obtained a constant deposition quantity across the web even, for example, for varying web speed, viscosity of coating agent, blade angle etc.

Figure 2:
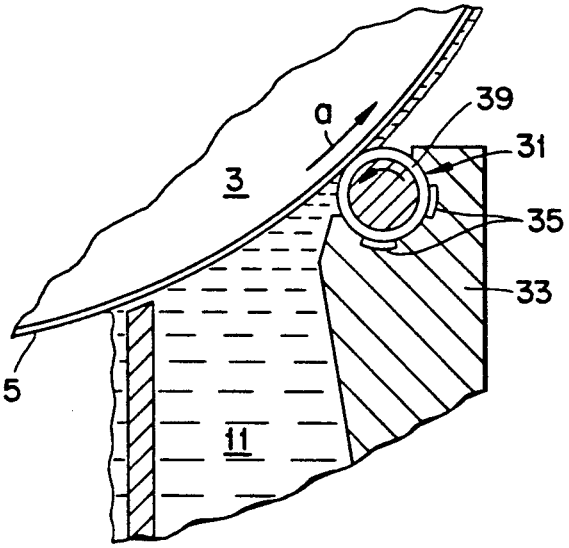
FIG. 2 is a diagrammatical view in section of an alternative embodiment of the apparatus according to the invention.

In FIG. 2 there is shown an alternative embodiment of the apparatus according to the invention. In this figure there is shown only the area around the metering device, whereas other details in connection with recirculation of the coating composition, the position and arrangement of the coating blade etc. are left out.

Figure 3:
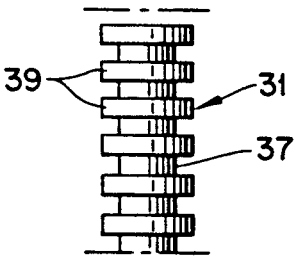
FIG. 3 shows an enlarged detail of this apparatus.

The apparatus of FIG. 2 includes a metering device in the form of a metering rod 31 which runs freely mounted in a rod holder 33. The metering rod 31 is rotatively mounted in said rod holder 33. As is clear from FIG. 3, wherein part of the metering rod 31 is shown from above, it can be considered to be an axis 37 having a circular cross section and carrying rings 39 evenly distributed along the axis. The metering rod may also, of course, be made in one piece with cut or milled grooves but can also be constructed from a central axis and rings 39 attached thereon. As seen in FIG. 2, the rings 39 contact the web intermittently at spaced locations.

The apparatus according to FIG. 2 offers the same advantages as with that shown in FIG. 1 by the fact that the metering rod 1 provides for deposition of strings or strands of coating composition having a constant cross section on the paper web 5 at the spaced locations resulting in even deposition of coating composition in spite of variations in the different factors previously indicated.

Figure 4:
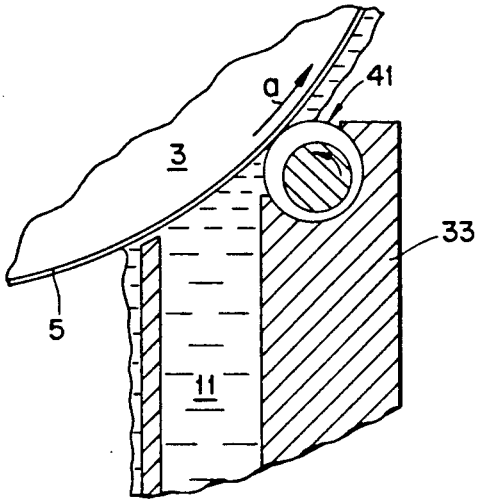
Figure 6:
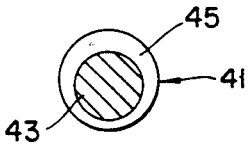
FIG. 6 shows a cross section of the metering device in the apparatus according to FIG. 4.

In FIG. 4 there is shown a modified embodiment comprising a fixed metering rod 41 which is fixedly mounted in rod holder 33 but which can be released and rotated to another position and fixed at said other position. In FIG. 6 this metering rod 41 is shown in cross section from which it is clear that the axis 43 of the rod is acentrically placed within rings 45 whereby the groove depth or ring height around the rod varies. By rotating the coating rod 41 in the rod holder and fixing same in the desired position the thickness of the strings or strands of coating composition deposited on the paper web 5 can thus be controlled so as to give the desired coating quantity.

Figure 5:
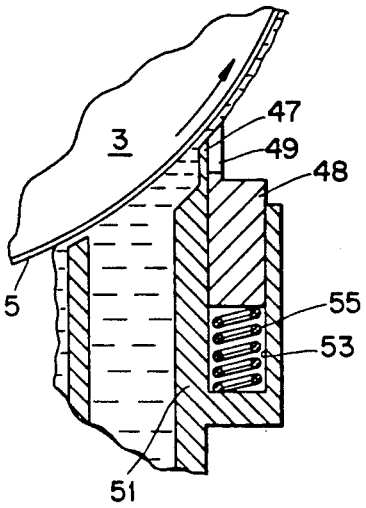
FIG. 5 shows diagrammatically a section through an alternative embodiment of the apparatus according to the invention.

In FIG. 5 there is shown another embodiment of the metering device according to the invention. This embodiment has a metering means built up from two blades 47,49. One blade 47 extending across the whole width of the paper web 5 defines a fixed slit between blade 47 and paper web 5 to define the thickness of the deposited coating composition. Downstreams of slit blade 47 and engaging same there is provided a toothed blade 49, the teeth of which have a length substantially exceeding the thickness of the deposited layer of coating composition. The teeth are evenly distributed along blade 49 over the whole width of paper web 5. Both blades 47,49 are attached in the blade fixture 51 and the blade holder 48, respectively. The blade holder 48 is movably arranged in a cavity 53 in blade fixture 51 and is biassed from below by compression springs 55 distributed in cavity 53 and acting to move the blade holder 48 and thereby the toothed blade 49 upwardly against the paper web 5. By this arrangement automatic displacement of the toothed blade 49 upwardly is obtained resulting in even engagement against paper web 5 in accordance with the wear of the teeth.

In the same way as previously described the apparatus shown in FIG. 5 provides for even deposition of strings or strands of coating composition onto paper web 5 resulting in constant metering of coating composition.

Figure 7:
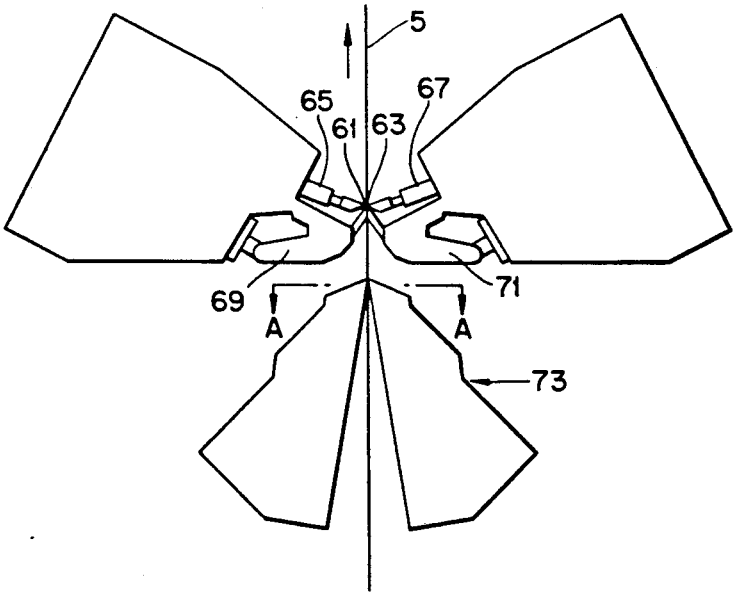
FIG. 7 shows diagrammatically still another embodiment of the apparatus according to the invention intended for two-sided coating.
Figure 8:
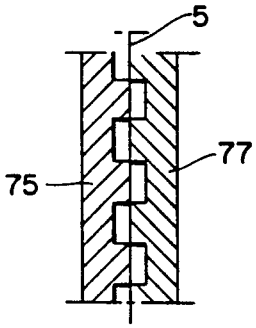
FIG. 8 shows an enlarged detail by the apparatus of FIG. 7.

In FIG. 7 and 8 there is shown an apparatus for two-sided coating of a paper web 5. This apparatus operates according to the so called Twin-blade principle, i.e. it comprises two juxtaposed coating blades 61,63 which are brought into engagement against the paper web 5 by pressure members 65,67. In a conventional manner blades 61,63 are attached to blade holders 69,71.

Below this Twin-blade arrangement there is arranged an applicator generally designated 73 which, as is clear from FIG. 8, comprises two juxtaposed toothed lamellae 75,77 wherein the teeth of the lamella 75, 77 contact the web intermittently at spaced locations. FIG. 8 thus shows a section of the upper part of the applicator 73 as seen in the direction of arrow A—A, i.e. from above. The two juxtaposed toothed lamellae 75,77 are displaced relative to each other in a direction across web 5 so that the teeth of one lamella are placed opposite to the recesses or gaps of the other lamella. By this arrangement and if the width of the teeth is less than the width of the gaps web 5 takes wave shape in its passage through applicator 73. Since web 5 is subject to certain yield this results in reduced risk for web failure.

By means of the apparatus shown in FIGS. 7 and 8 there is thus obtained a two-sided coating of a travelling web 5, wherein even and constant metering of a coating composition is obtained in accordance with the basic principle underlying this invention.

The invention also covers an alternative apparatus for two-sided coating of a paper web, and this apparatus consists in principle of doubling the apparatus according to FIG. 1. Before engagement of paper web 5 with roll 3 a similar apparatus as that in FIG. 1 shown can be positioned, whereby there will be obtained deposition of strings or strands directly on the surface of roll 3. The other side of paper web 5 will be coated in the manner shown in FIG. 1, and in this way a two-sided coating of paper web 5 will be obtained with constant metering in accordance with the invention. This arrangement can, of course, also be applied in connection to the apparatus as according to FIG. 2 to 6.

With regard to the embodiment according to the FIG. 7 it can, of course, be modified by replacing one blade 61 thereof with a backing roll in a conventional manner.

I claim:

1. An apparatus for coating both sides of a travelling web, comprising:

means, extending substantially across the entire width of each side of the web, for metering coating agent onto both sides of the web, said metering means including an intermittent contact surface on each side of the web which contacts the web at spaced locations across the web;

spaces, arranged between said contact surfaces, for depositing strands of said coating agent on the web between said spaced locations;

wherein said contact surfaces on one side of the web are aligned with said spaces on the other side of the web; and wherein a width of each of said contact surfaces on one side of the web is less than a width of each of said spaces aligned with said contact surfaces on the other side of the web whereby the web assumes a wave shape in said metering means.

2. An apparatus as claimed in claim 1, wherein said metering means comprises lamellae having teeth which contact the web at spaced locations and wherein said spaces comprise gaps between said teeth.

3. An apparatus as claimed in claim 2, wherein said lamella teeth on one side of the web are directly opposite said gaps between said lamella teeth on the other side of the web.

4. An apparatus as claimed in claim 1, further comprising:

means, on each side of the web extending across the entire width of the web downstream of said metering means, for evening the thickness of the coating.

5. An apparatus as claimed in claim 4, wherein said evening means is a coating blade.

6. An apparatus as claimed in claim 2, further comprising means, on each side of the web extending across the entire width of the web downstream of said metering means, for evening the thickness of the coating.

7. An apparatus as claimed in claim 6, wherein said evening means is a coating blade.

* * * * *